US011638673B2

(12) United States Patent
Chen et al.

(10) Patent No.: US 11,638,673 B2
(45) Date of Patent: May 2, 2023

(54) HIP-KNEE PASSIVE EXOSKELETON DEVICE BASED ON CLUTCH TIME-SHARING CONTROL

(71) Applicant: Huazhong University of Science and Technology, Hubei (CN)

(72) Inventors: Wenbin Chen, Hubei (CN); Tongtong Wei, Hubei (CN); Tiancheng Zhou, Hubei (CN); Shuang Wu, Hubei (CN); Caihua Xiong, Hubei (CN)

(73) Assignee: Huazhong University of Science and Technology, Hubei (CN)

( * ) Notice: Subject to any disclaimer, the term of this patent is extended or adjusted under 35 U.S.C. 154(b) by 287 days.

(21) Appl. No.: 16/414,926

(22) Filed: May 17, 2019

(65) Prior Publication Data

US 2020/0085667 A1 Mar. 19, 2020

(30) Foreign Application Priority Data

Sep. 14, 2018 (CN) ..... 201811075244.0

(51) Int. Cl.
*A61H 3/00* (2006.01)
*A61H 1/02* (2006.01)

(52) U.S. Cl.
CPC ..... *A61H 3/00* (2013.01); *A61H 1/0262* (2013.01); *A61H 2003/007* (2013.01);
(Continued)

(58) Field of Classification Search
CPC .. A61H 3/00; A61H 1/0262; A61H 2003/007; A61H 2201/1253;
(Continued)

(56) References Cited

U.S. PATENT DOCUMENTS 10,278,885 B1 * 5/2019 Smith ..... A61H 3/00
2012/0259429 A1 * 10/2012 Han ..... A61H 3/008 623/24

(Continued)

*Primary Examiner* — Jerrah Edwards
*Assistant Examiner* — Aren Patel
(74) *Attorney, Agent, or Firm* — Hamre, Schumann, Mueller & Larson, P.C.

(57) ABSTRACT

The disclosure belongs to the technical field of lower limb exoskeleton, and specifically discloses a hip-knee passive exoskeleton device based on clutch time-sharing control, comprising a waist support subassembly, connection subassemblies, thigh subassemblies, clutch subassemblies, shank subassemblies and elastic member subassemblies, the waist support subassembly is configured to be connected to the waist, the connection subassemblies are configured to include two connection subassemblies which are arranged in bilateral symmetry on two sides of the support subassembly, the thigh subassemblies are configured to include two thigh subassemblies which are respectively connected to the two connection subassemblies, the clutch subassemblies are configured to include two clutch subassemblies which are respectively mounted on the two thigh subassemblies, the shank subassemblies are configured to include two shank subassemblies which are arranged in bilateral symmetry below the two thigh subassemblies, the elastic member subassemblies are configured to include two elastic member subassemblies which are arranged in bilateral symmetry. The disclosure can assist the movements of the knee and hip joints, thereby improving the energy utilization efficiency and reducing the metabolic energy consumption of walking.

5 Claims, 3 Drawing Sheets

(52) U.S. Cl.
CPC ..... *A61H 2201/1253* (2013.01); *A61H 2201/1445* (2013.01); *A61H 2201/163* (2013.01); *A61H 2201/1642* (2013.01); *A61H 2201/1652* (2013.01)

(58) Field of Classification Search
CPC ..... A61H 2201/1445; A61H 2201/163; A61H 2201/1642; A61H 2201/1652
See application file for complete search history.

(56) References Cited

U.S. PATENT DOCUMENTS

| | | | | |
|---|---|---|---|---|
| 2016/0361222 | A1* | 12/2016 | Publicover | A61F 5/0123 |
| 2017/0049659 | A1* | 2/2017 | Farris | A61H 1/0244 |
| 2017/0246740 | A1* | 8/2017 | Barnes | B25J 9/0006 |
| 2018/0177670 | A1* | 6/2018 | Shim | B25J 9/0006 |
| 2018/0193172 | A1* | 7/2018 | Smith | B25J 9/148 |
| 2018/0280178 | A1* | 10/2018 | Shimada | B25J 9/1045 |
| 2018/0325764 | A1* | 11/2018 | Yagi | A61H 1/0244 |

* cited by examiner

HIP-KNEE PASSIVE EXOSKELETON DEVICE BASED ON CLUTCH TIME-SHARING CONTROL

BACKGROUND

Technical Field

The disclosure belongs to the technical field of lower limb exoskeleton, and more particularly relates to a hip-knee passive exoskeleton device based on clutch time-sharing control.

Description of the Related Art

Although the emergence of wheeled vehicles such as cars and trains greatly facilitates people's travel, it is easily restricted by terrain conditions. Humans still walk about 10,000 steps per day, and walking is irreplaceable in people's daily life. However, due to a large amount of soft tissue friction inside the human body, air damping, sliding friction of the shoe soles and the like, the movement efficiency of the human walking is low. At the same time, muscle fatigue caused by long-term walking will reduce people's exercise capacity and cause inconvenience in daily life. Therefore, it is of great scientific significance and practical value to develop a lower limb exoskeleton device that can assist human walking, improve human walking efficiency and enhance human movement ability.

The passive lower limb exoskeleton is different from the traditional powered lower limb exoskeleton. The traditional powered lower limb exoskeleton is driven by the actuator, and usually also includes an energy source, sensors, a control system and the like. Such exoskeleton is usually complicated in structure and heavy in equipment, and is often used for patient rehabilitation training and individual combat of troops, but not suitable for normal walking in human's daily life. The passive lower limb exoskeleton is more in line with the human movement law, and only relies on the movement of external elastic components with the lower limb to provide power assistance, and thus, such exoskeleton does not need complex components such as sensors and energy sources, only relying on clever structural design and the arrangement of elastic components to assist the daily human walking and reduce the metabolism energy consumption of walking. The passive lower limb exoskeleton has low manufacturing cost, simple structure and light-weight, and thus it is not only a research hotspot in the frontier of exoskeleton robotics, but also has broad application prospects.

At present, a variety of passive lower limb exoskeleton devices for assisting walking, running and jumping have been developed in China, but there are few passive lower limb exoskeleton devices that can successfully improve walking efficiency and reduce walking metabolic energy consumption. Currently, the developed passive exoskeleton devices that can reduce the metabolic energy consumption are single joint exoskeleton devices, and most of them are aimed to the ankle or hip joint that does more positive work during walking, completely ignoring the movement effect of the knee joint and the movement synergistic relationship of the whole lower limb. This severely limits the movement assisting effect of the passive lower limb exoskeleton devices, and it is difficult to further improve the utilization efficiency of the human metabolic energy. Through developing a multi joint passive exoskeleton device capable of assisting both the knee joint and the hip joint in combination with the walking movement characteristics of the knee joint, it is expected to not only fully utilize the energy of the knee joint and the hip joint, but also further improve the walking efficiency and reduce the walking metabolic energy.

SUMMARY

In view of the above-described defects or improvement requirements in the art, the present disclosure provides a hip-knee passive exoskeleton device based on clutch time-sharing control, which combines the walking movement characteristics of the knee joint and the hip joint to enable the knee joint energy to be transferred to the hip joint through an external device so as to assist the movement of both the knee joint and the hip joint, thereby improving the energy utilization efficiency and reducing the walking metabolic energy consumption.

In order to achieve the above objective, the present disclosure provides a hip-knee passive exoskeleton device based on clutch time-sharing control, comprising: a waist support subassembly, connection subassemblies, thigh subassemblies, clutch subassemblies, shank subassemblies and elastic member subassemblies, wherein the waist support subassembly is configured to be connected to the waist, the connection subassemblies are configured to connect the waist support subassembly and the thigh subassemblies and include two connection subassemblies which are arranged in bilateral symmetry on two sides of the waist support subassembly, the thigh subassemblies are configured to include two thigh subassemblies which are respectively connected to the two connection subassemblies and are connected to the thighs, the clutch subassemblies are configured to include two clutch subassemblies which are respectively mounted on the two thigh subassemblies to perform time-sharing control of the energy of the knee and hip joints, the shank subassemblies are configured to include two shank subassemblies which are arranged in bilateral symmetry below the two thigh subassemblies and are connected to the shanks, the elastic member subassemblies are configured to include two elastic member subassemblies which are arranged in bilateral symmetry, connects the waist support subassembly and the shank subassemblies and passes through the clutch subassemblies.

Preferably, the waist support subassembly includes two waist braces, a waist flexible strap and a waist brace connector, the waist brace connector is configured to connect one ends of the two waist braces, and the waist flexible strap is configured to connect the other ends of the two waist braces, so that the two waist braces is connected to the waist to support the force.

Further preferably, each of the connection subassemblies includes a pawl force arm connector, a pawl force arm, a spring force arm, a hip joint movement connector, a thigh connecting rod, and a knee joint movement connector, wherein the pawl force arm connector is configured to connect the pawl force arm to the waist brace, the spring force arm is mounted on the waist brace, the hip joint movement connector is respectively hinged to the pawl force arm connector and an upper end of the thigh connecting rod to ensure the free movement of the thigh connecting rod with the thigh, and the knee joint movement connector is hinged to a lower end of the thigh connecting rod.

Further preferably, each of the thigh subassemblies includes a thigh rear hoop and a flexible thigh strap, the thigh rear hoop is hinged to the knee joint movement connector, and the flexible thigh strap is configured to closely attach the thigh rear hoop to the thigh.

Further preferably, each of the clutch subassemblies includes a clutch bracket, a clutch cover plate, a ratchet wheel, a stroke stop, a wire wheel, a pawl and a pawl rope, wherein the clutch bracket is mounted on the thigh rear hoop, the ratchet wheel, the stroke stop and the wire wheel are mounted between the clutch bracket and the clutch cover plate via a spline shaft to ensure synchronous rotation of the ratchet wheel, the stroke stop and the wire wheel, the pawl is rotatably mounted between the clutch bracket and the clutch cover plate via a pawl shaft, the pawl rope has an upper end connected to the pawl force arm and a lower end connected to the pawl, and the pawl is located on the side of the ratchet wheel and is engageable with the ratchet wheel.

Further preferably, each of the shank subassemblies includes a shank rear hoop, a shank front hoop and a flexible shank strap, the shank rear hoop and the shank front hoop are hinged together by hinge pins, and the shank flexible strap secures the shank rear hoop and the shank front hoop to the shank.

Further preferably, each of the elastic element subassemblies includes a tension spring, a spring connecting rope, a pawl torsion spring and a wire wheel torsion spring, wherein the tension spring has an upper end connected to the spring force arm and a lower end connected to an upper end of the spring connecting rope, the spring connecting rope has a middle portion connected to the wire wheel and a lower end connected to the shank rear hoop, the pawl torsion spring is mounted between the pawl and the clutch cover plate to return the pawl to an initial position, and the wire wheel torsion spring is mounted between the wire wheel and the clutch bracket to return the wire wheel to an initial position.

In general, by comparing the above technical solution of the present inventive concept with the prior art, the present disclosure has the following beneficial effects:

1. In the present disclosure, through the design and cooperation of key components such as a waist support subassembly, connection subassemblies, thigh subassemblies, clutch subassemblies, shank subassemblies and elastic member subassemblies, a hip-knee passive exoskeleton device based on clutch time-sharing control is obtained, which can fully utilize the energy of the hip and knee joints and has the advantages of high walking efficiency and strong applicability.

2. In the present disclosure, through providing a clutch triggered by the angles of the hip and knee joints, the spring is stretched to store the energy when the knee joint performs the negative work, and shrinks to release the energy when the hip joint performs the positive work, so that the knee joint energy can be transferred to the hip joint through an external device to assist the movements of both the knee joint and the hip joint, thereby improving the utilization efficiency of the energy and reducing the metabolic energy consumption of walking.

DETAILED DESCRIPTION OF THE EMBODIMENTS

For clear understanding of the objectives, features and advantages of the present disclosure, detailed description of the present disclosure will be given below in conjunction with accompanying drawings and specific embodiments. It should be noted that the embodiments described herein are only meant to explain the present disclosure, and not to limit the scope of the present disclosure. Furthermore, the technical features related to the embodiments of the disclosure described below can be mutually combined if they are not found to be mutually exclusive.

Figure 1:
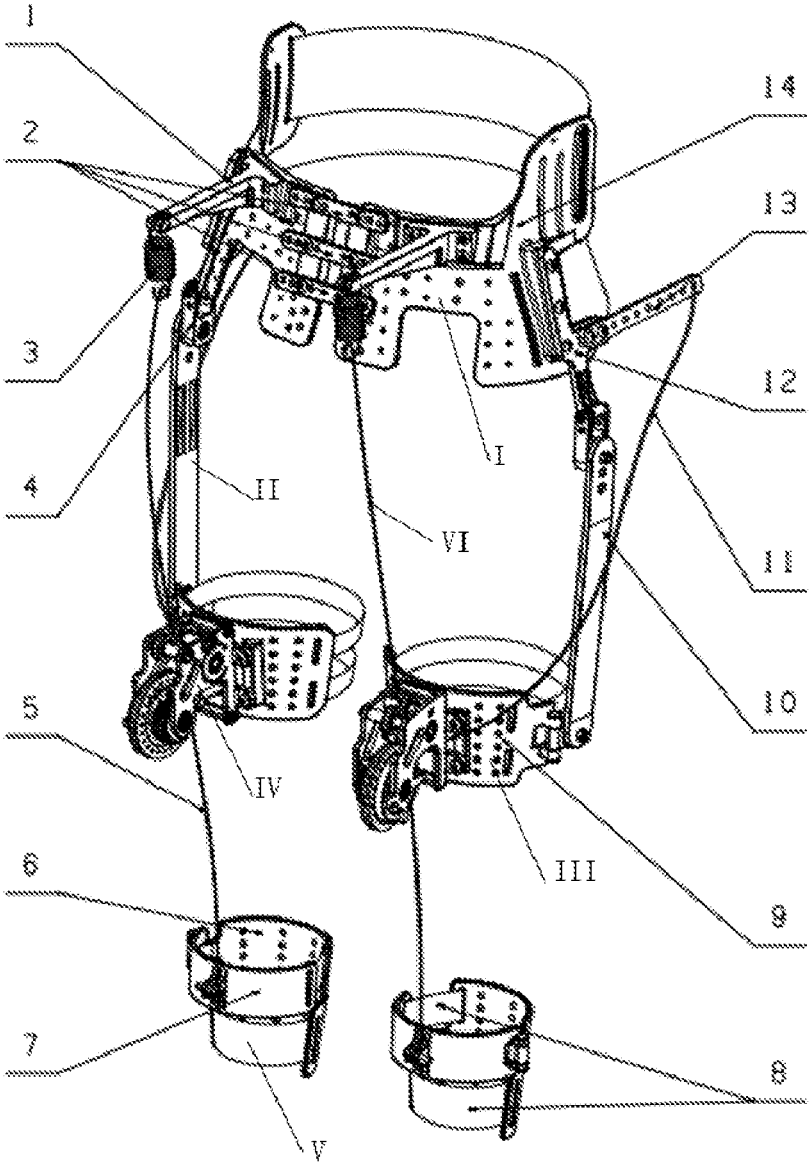
FIG. 1 is a schematic diagram of the overall structure of a hip-knee passive exoskeleton device based on clutch time-sharing control according to the present disclosure.

As shown in FIG. 1, a hip-knee passive exoskeleton device based on clutch time-sharing control according to embodiments of the present disclosure includes a waist support subassembly I, connection subassemblies II, thigh subassemblies III, clutch subassemblies IV, shank subassemblies V and elastic member subassemblies VI, in which the waist support subassembly I is configured to be connected to the waist, the connection subassemblies II are configured to connect the waist support subassembly I and the thigh subassemblies III and include two connection subassemblies which are arranged in bilateral symmetry on two sides of the waist support subassembly I, the thigh subassemblies III are configured to include two thigh subassemblies which are respectively connected to the two connection subassemblies II and are connected to the thighs, the clutch subassemblies IV are configured to include two clutch subassemblies which are respectively mounted on the two thigh subassemblies III to perform time-sharing control of the energy of knee joints and hip joints, the shank subassemblies V are configured to include two shank subassemblies which are arranged in bilateral symmetry below the two thigh subassemblies III and are connected to the shanks, the elastic member subassemblies VI are configured to include two elastic member subassemblies which are arranged in bilateral symmetry, connects the waist support subassembly I and the shank subassemblies V and passes through the clutch subassemblies IV in the middle, and are used for storing energy and providing torques to assist the movements of the knee and hip joints.

Figure 2:
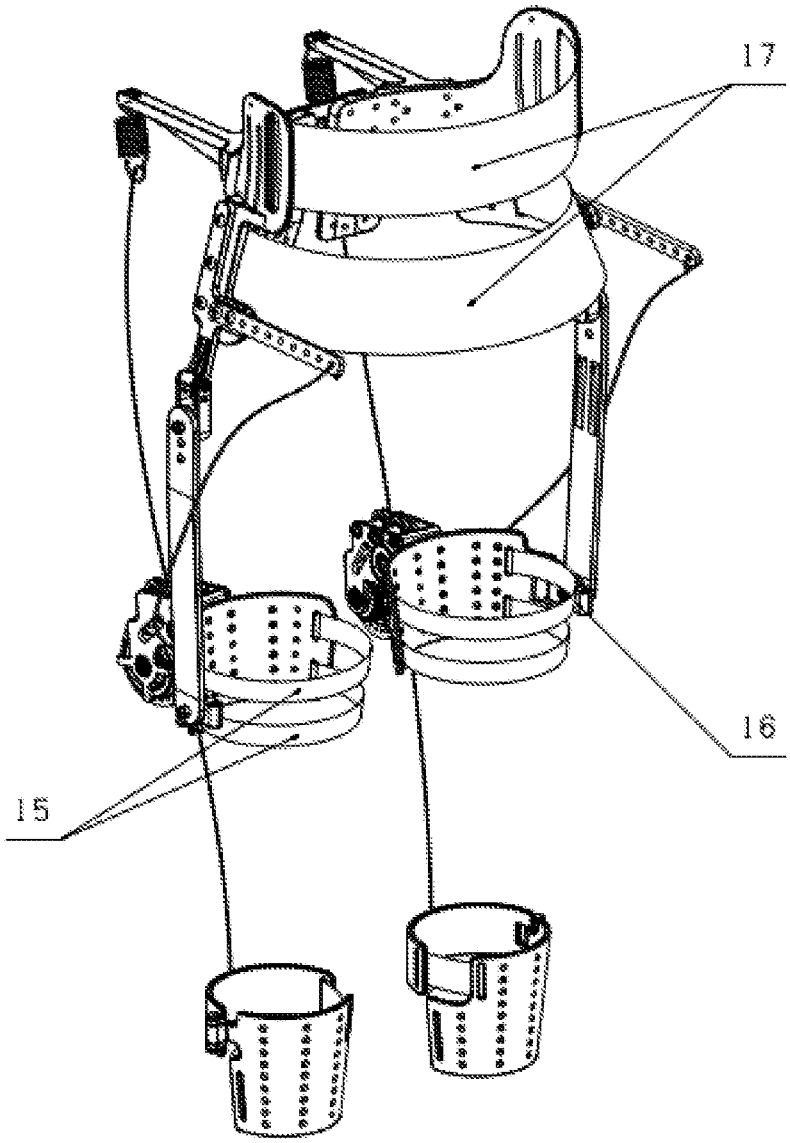
FIG. 2 is an isometric diagram of the overall structure of the hip-knee passive exoskeleton device based on clutch time-sharing control according to the present disclosure.

As shown in FIGS. 1 and 2, the waist support subassembly I includes two waist braces 14, a waist flexible strap 17 and a waist brace connector 2, in which the waist brace connector 2 is configured to connect one ends of the two waist braces 14, and the waist flexible strap 17 is configured to connect the other ends of the two waist braces 14, so that the two waist braces 14 are connected to the waist to support the force. Specifically, each waist brace 14 has boss planes on the side and the back, on which threaded holes are arranged for connecting the waist brace connector 2, a spring force arm 1 and a pawl force arm connecting member 12. The waist brace connector 2 has through holes distributed at a certain interval for adjusting a distance between the left and right waist braces 14 according to the wearer's shape. The waist brace connector 2 is connected to the waist braces 14 by screws, and the waist braces are further provided with through holes for reducing the mass.

As shown in FIGS. 1 and 2, each of the connection subassemblies II includes a pawl force arm connector 12, a pawl force arm 13, a spring force arm 1, a hip joint movement connector 4, a thigh connecting rod 10 and a knee joint movement connector 16, in which the pawl force arm connector 12 is configured to connect the pawl force arm 13 to the waist brace 14, the spring force arm 1 is mounted on the waist brace 14, the hip joint movement connector 4 is respectively hinged to the pawl force arm connector 12 and an upper end of the thigh connecting rod 10 to ensure the free movement of the thigh connecting rod 10 with the thigh, and the knee joint movement connector 16 is hinged to a lower end of the thigh connecting rod 10.

Specifically, the pawl force arm connector 12 is fixed to the waist brace 14 by screws, and two threaded holes are disposed in the horizontal direction for mounting the pawl force arm 13 on the pawl force arm connector 12 by screws. The pawl force arm connector 12 is provided with a cylindrical slot on the lowermost end, and the hip joint movement connector 4 is rotatably mounted on the pawl force arm connector 12 by a deep groove ball bearing, a bolt and a nut. The pawl force arm 13 is provided with through holes uniformly arranged at a certain distance for fixing and connecting an upper end of a pawl string 11. The hip joint movement connector 4 is provided with a through hole for connecting the pawl force arm connector 12 at the upper end, and a cylindrical slot at the lower end, and the thigh connecting rod 10 is rotatably mounted on the hip joint movement connector 4 by a deep groove ball bearing, a bolt and a nut. Through the above connection, the thigh connecting rod 10 is ensured to freely move with the thigh. The thigh connecting rod 10 is provided with, at the upper end, through holes uniformly arranged at a certain distance for adjusting a distance between the knee joint movement connector 16 and the hip joint movement connector 4 according to different heights of the wearers.

As shown in FIGS. 1 and 2, each of the thigh subassemblies III includes a thigh rear hoop 9 and a thigh flexible strap 15, in which the thigh rear hoop 9 is hinged to the knee joint movement connector 16, and the thigh flexible strap 15 is configured to closely attach the thigh rear hoop 9 to the thigh. Specifically, a cylindrical slot is provided in the middle of the knee joint movement connector 16, and the knee joint movement connector 16 is rotatably mounted on the lower end of the thigh connecting rod 10 by a deep groove ball bearing, a bolt and a nut. The knee joint movement connector 16 is provided in bilateral symmetry with cylindrical through holes for placing a hinge pin, and the thigh rear hoop 9 is rotatably mounted on the knee joint movement connector 16 through the hinge pin. Further, a boss plane is arranged in the middle portion of the thigh rear hoop 9, threaded holed are drilled on the boss plane for mounting a clutch cover plate 18 and a clutch bracket 23, the thigh flexible strap 15 passes through both sides of the thigh rear hoop 9 to attach the thigh rear hoop 9 to the human thigh, so that the thigh rear hoop 9 and the clutch subassembly are allowed to move together with the thigh. In addition, the thigh rear hoop 9 is also provided with through holes for reducing the mass.

Figure 3:
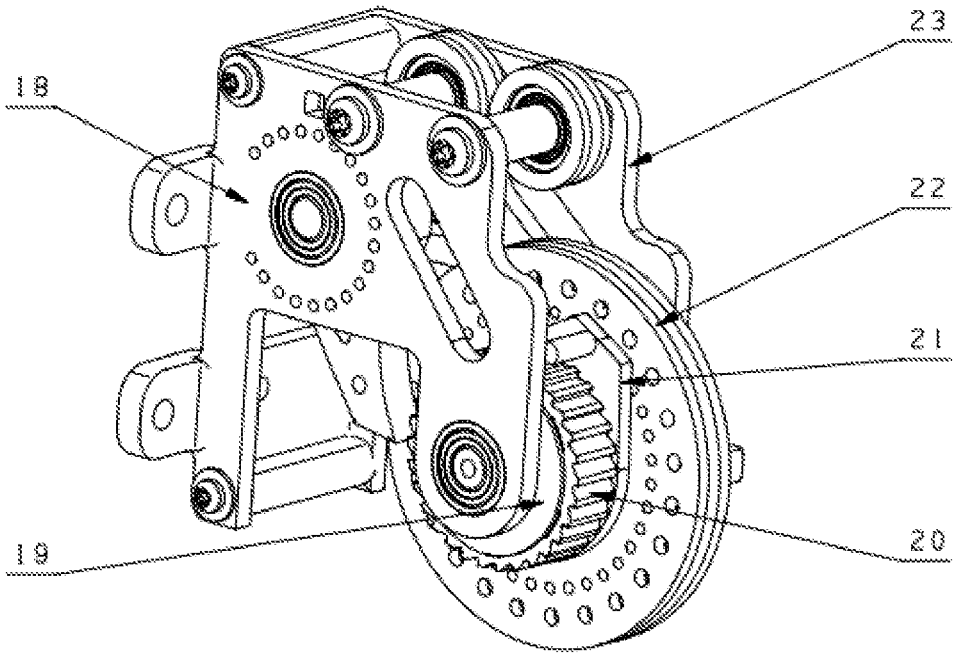
FIG. 3 is an isometric diagram of a clutch according to the present disclosure.
Figure 4:
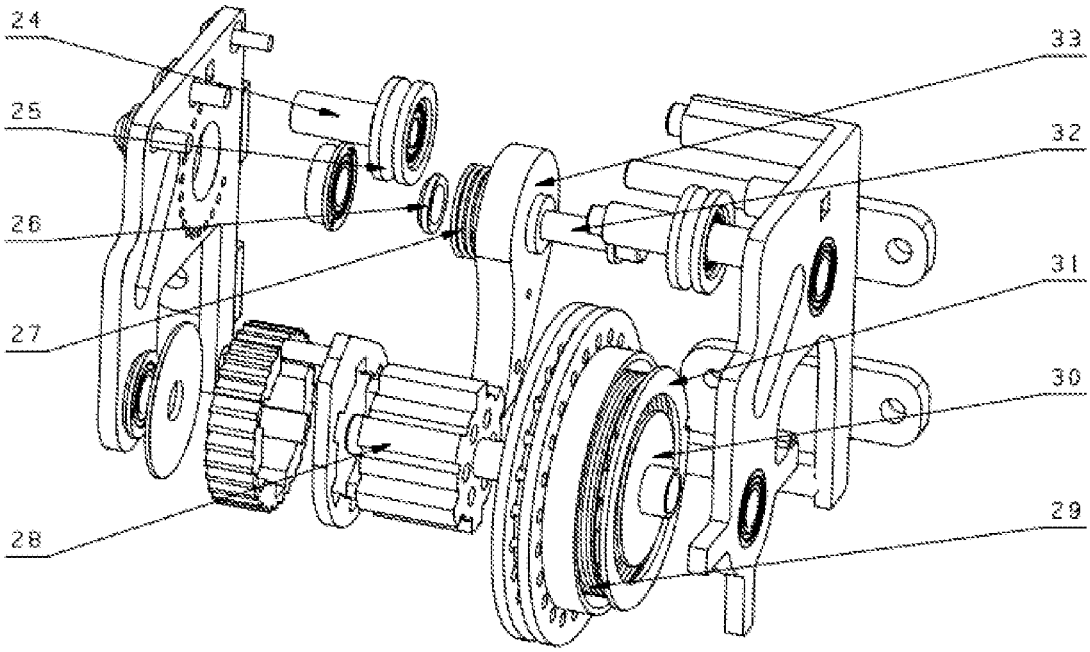
FIG. 4 is an exploded diagram of the clutch according to the present disclosure.

As shown in FIGS. 3 and 4, each of the clutch subassemblies IV includes a clutch bracket 23, a clutch cover plate 18, a ratchet wheel 20, a stroke stop 21, a wire wheel 22, a pawl 33 and a pawl rope 11, in which the clutch bracket 23 is mounted on the thigh rear hoop 9; the ratchet wheel 20, the stroke stop 21 and the wire wheel 22 are mounted between the clutch bracket 23 and the clutch cover plate 18 via a spline shaft 28 to ensure synchronous rotation of the ratchet wheel 20, the stroke stop 21 and the wire wheel 22, the pawl 33 is rotatably mounted between the clutch bracket 23 and the clutch cover plate 18 via a pawl shaft 32, the pawl rope 11 has an upper end connected to the pawl force arm 13 and a lower end connected to the pawl 33, so that when the thigh swings back, the pawl rope 11 pulls the pawl 33 to rotate, disengaging the pawl 33 from the ratchet wheel 20.

Specifically, the clutch cover plate 18 and the clutch bracket 23 are each provided with circular holes for placing flange bearings. The ratchet wheel 20, the stroke stop 21 and the wire wheel 22 are closely attached to the spline shaft 28 to ensure synchronous rotation of the ratchet wheel 20, the stroke stop 21 and the wire wheel 22. The spline shaft 28 is rotatably mounted in the flange bearings arranged in parallel on the clutch bracket 23 and the clutch cover plate 18. Specifically, the wire wheel 22 is mounted on the long axis side of the spline shaft 28, the ratchet wheel 20 is passed through by the spline shaft 28 on a side of the wire wheel 22 near the clutch cover plate 18, a ratchet wheel stop 19 is passed through by the spline shaft 28 between the ratchet wheel 20 and the clutch cover plate 18 to prevent the axial movement of the ratchet wheel 20 on the spline shaft 28, and a wire wheel stop 30 is passed through by the spline shaft 28 between the wire wheel 22 and the clutch bracket 23 to prevent the axial movement of the wire wheel 22 on the spline shaft 28.

Further, the pawl 33 is rotatably mounted by the pawl shaft 32 in the flange bearings arranged in parallel on the clutch bracket 23 and the clutch cover plate 18. The pawl 33 is provided with a torsion spring groove for mounting a pawl torsion spring 27, and is mounted such that the torsion spring groove is directed toward the clutch cover plate 18. A side of the pawl torsion spring 27 is mounted in the torsion spring groove of the pawl 33, and the other side of the pawl torsion spring 27 is mounted on a hole of the clutch cover plate 18, so that the pawl 33 can be returned to the initial state without being subjected to an external force. A pawl stop 26 is passed through by the pawl shaft 32 between the pawl 33 and the clutch cover plate 18. Further, the clutch bracket 23 is provided with a stepped rod on which a plastic guide rail 25 is mounted to determine the direction of the spring connecting rope 5. A rail retaining ring 24 is passed through by the stepped rod on the clutch bracket 23 and is disposed between the plastic guide rail 25 and the clutch cover plate 18 to axially position the plastic guide rail 25. The wire wheel 22 is provided with a torsion spring groove, a side of a wire wheel torsion spring 29 is mounted in the torsion spring groove of the wire wheel 22, and the other side of the wire wheel torsion spring 29 is mounted on a hole of the clutch bracket 23, so that the wire wheel 22 can be returned to the initial installation state without being subjected to an external force. A torsion spring stop 31 is located between the wire wheel 22 and the clutch bracket 23, and coaxially covers the wire wheel torsion spring 29 to prevent the movement of the wire wheel torsion spring 29.

As shown in FIGS. 1 and 2, each of the shank subassemblies V includes a shank rear hoop 7, a shank front hoop 6 and a shank flexible strap 8, in which the shank rear hoop 7 and the shank front hoop 6 are hinged together by hinge pins, and the shank flexible strap 8 secures the shank rear hoop 7 and the shank front hoop 6 to the shank. Specifically, the shank front hoop 6 is provided with, at the side end, circular through holes for placing hinge pins, the shank rear hoop 7 is rotatably mounted on the shank front hoop 6 through the hinge pins, and the shank flexible strap 8 closely attaches the shank rear hoop 7 and the shank front hoop 6 to the shank, so that the shank subassembly V can move with the shank.

As shown in FIGS. 1 and 4, each of the elastic element subassemblies VI includes a tension spring 3, a spring connecting rope 5, a pawl torsion spring 27 and a wire wheel torsion spring 29, in which the tension spring 3 has an upper end connected to the spring force arm 1 and a lower end connected to an upper end of the spring connecting rope 5, and the spring connecting rope 5 has a middle portion connected to the wire wheel 22 and a lower end connected to the shank rear hoop 7. The pawl torsion spring 27 is mounted between the pawl 33 and the clutch cover plate 18 to return the pawl 33 to the initial position. When the thigh swings back, the pawl rope 11 will pull the pawl 33 to rotate, so that the pawl 33 is disengaged from the ratchet wheel 20, and at this time, the wire wheel pawl torsion spring 27 has a certain restoring moment. When the thigh swings forward, the pawl rope 11 is in a relaxed state, and the pawl torsion spring 27 drives the pawl 33 back to the initial position. The wire wheel torsion spring 29 is mounted between the wire wheel 22 and the clutch bracket 23 to return the wire wheel 22 to the initial position. When the human body is in an upright state, the spring connecting rope 5 pulls the wire wheel 22 to rotate by a certain angle, and at this time, the wire wheel torsion spring 29 has a certain restoring moment. When the thigh swings back and the knee joint bends, the spring connecting rope 5 is in a relaxed state, and the wire wheel 22 is returned to the initial installation position by the wire wheel torsion spring 29.

Specifically, the upper end of the tension spring 3 is hooked on the spring force arm 1, the lower end of the tension spring 3 is bundled with the upper end of the spring connecting rope 5, the middle position of the spring connecting rope 5 is fixed on the hole of the wire wheel 22 to allow the middle position of the spring connecting rope 5 to rotate synchronously with the wire wheel 22, and the lower end of the spring connecting rope 5 is fixedly connected to the shank rear hoop 7, so that the tension spring 3 is stretched in a negative work phase of the knee joint to store the energy to assist the movement of the knee joint, and shrinks in a positive work phase of the hip joint to release the energy to assist the movement of the hip joint. The spring connecting rope 5 is a polyethylene rope. As shown in FIG. 3, by adjusting the initial positions of the pawl torsion spring 27 and the wire wheel torsion spring 29, in the initial state, the pawl 33 approaches but does not engage with the ratchet wheel 20, and after the wire wheel 22 rotates counterclockwise by a certain angle (for example, 100°), the pawl 33 is pushed off by the stroke stop 21. When the wire wheel 22 is released and returned, the stroke stop 21 presses the pawl 33 downward so that the pawl 33 and the ratchet wheel 20 engage with each other and cannot rotate. The initial state of the device is a wear state of the wearer when standing normally. At this time, the wire wheel 22 is rotated by about 100°, the wire wheel torsion spring 29 rotates synchronously with the wire wheel 22, and thus the wire wheel torsion spring 29 is twisted by about 100° and has a large restoring moment, so that the pawl 33 is pressed by the stroke stop 21 and engage with the ratchet wheel 20 to achieve self-lock. The pawl torsion spring 27 rotates synchronously with the pawl 33, and has a certain restoring moment. The pawl rope 11 is adjusted to be in a tight state, the spring connecting rope 5 is adjusted to be in a tight state, and at this time, the tension spring 3 is in a tensionless state.

Taking the initial phase of the human walking at the time of the toe off as an example, the normal operation of the device is described below.

First stage: at the time of the toe off, the hip joint is at the maximum extension angle. At this time, the spring connecting rope 5 between the wire wheel 22 and the tension spring 3 is in a relaxed state, the spring connecting rope 5 between the shank rear hoop 7 and the wire wheel 22 is in a tight state, the tension spring 3 is in a free state, and the pawl rope 11 pulls the pawl 33 such that the pawl 33 is disengaged from the ratchet wheel 20 and the ratchet wheel 20 can be rotated back; then the thigh swings forward and the shank bends, the hip joint rotates from the maximum extension angle to zero, and the knee joint rotates from zero to the near maximum flexion angle. At this stage, the ratchet wheel 20 and the wire wheel 22 are synchronously returned under the action of the wire wheel torsion spring 29, so that the spring connecting rope 5 between the wire wheel 22 and the tension spring 3 is still in a relaxed state, at which time the pawl 33 is returned under the action of the pawl torsion spring 27, and the pawl rope 11 is in an initial tension state.

Second stage: the hip joint rotates from zero to the maximum flexion angle, and the knee flexes to the maximum angle. At this stage, the thigh swings forward and the shank bends, the spring connecting rope 5 is completely in a tight state, the tension spring 3 is in a free state, and the pawl rope 11 is in a relaxed state.

Third stage: the hip joint maintains the maximum flexion angle, and the knee joint rotates from the maximum flexion angle to the maximum extension angle. At this stage, the thigh does not rotate, and the shank swings forward, so that the stroke stop 21 rotates synchronously with the wire wheel 22 to push away and pass over the pawl 33, and the spring connecting rope 5 is in a stretched state while the tension spring 3 is elongated to store the energy of the shank movement to assist the negative work of the knee joint.

Fourth stage: the knee joint rotates slightly, and the hip joint rotates from the maximum flexion angle to zero. At this stage, the thigh swings back, the stroke stop 21 is slightly rotated back, and the pawl 33 is pressed, so that the pawl 33 engages with the ratchet wheel 20 to lock. The pawl rope 11 is gradually stretched to an initial tension state, and the tension spring 3 is shortened to release energy and assist the positive work of the hip joint.

Fifth stage: the knee joint rotates slightly, and the hip joint rotates from zero to the maximum extension angle. At this stage, the thigh swings back, the pawl rope 11 is tightened and the pawl 33 is pulled apart, so that the pawl 33 is disengaged from the ratchet wheel 20 and the stroke stop 21 is lifted off. The stroke stop 21 and the ratchet wheel 20 have a restoring force under the action of the wire wheel torsion spring 29, the spring connecting rope 5 between the wire wheel 22 and the tension spring 3 is in a relaxed state, the spring connecting rope 5 between the shank rear hoop 7 and the wire wheel 22 is in a tight state, and the tension spring 3 is in a free state.

In the present disclosure, through combining the movement law and the work characteristic of the knee joint and the hip joint during walking and utilizing the high-efficiency springs as the elastic external tendons of the human body, the tension spring is stretched to store the energy when the knee joint does the negative work, and shrinks to release the energy when the hip joint does the positive work by virtue of a clutch triggered by the angles of the hip and knee joints, so that the knee joint energy can be transferred to the hip joint through an external device to assist the movements of both the knee joint and the hip joint, thereby improving the utilization efficiency of the energy and reducing the metabolic energy consumption of walking.

It should be readily understood to those skilled in the art that the above description is only preferred embodiments of the present disclosure, and does not limit the scope of the present disclosure. Any change, equivalent substitution and modification made without departing from the spirit and scope of the present disclosure should be included within the scope of the protection of the present disclosure.

What is claimed is:

1. A hip-knee passive exoskeleton device based on clutch time-sharing control, consisting essentially of:

a waist support subassembly, connection subassemblies, thigh subassemblies, clutch subassemblies, shank subassemblies and elastic member subassemblies, wherein the waist support subassembly is configured to be connected to a waist of a wearer, the connection subassemblies connect the waist support subassembly and the thigh subassemblies and include two connection subassemblies which are arranged in bilateral symmetry on two sides of the waist support subassembly, wherein each of the connection subassemblies includes a pawl force arm connector, a pawl force arm extending in a backward direction of the wearer, a spring force arm extending in a forward direction of the wearer, a hip joint movement connector, a thigh connecting rod, and a knee joint movement connector, wherein the pawl force arm connector connects the pawl force arm to the waist brace, the spring force arm is mounted on the waist support subassembly, the hip joint movement connector is respectively hinged to the pawl force arm connector and an upper end of the thigh connecting rod to ensure the free movement of the thigh connecting rod with the thigh, and the knee joint movement connector is hinged to a lower end of the thigh connecting rod, the thigh subassemblies include two thigh subassemblies which are respectively connected to the two connection subassemblies and are configured to be connected to thighs of the wearer, the clutch subassemblies include two clutch subassemblies which are respectively mounted on the two thigh subassemblies to perform time-sharing control of energy of the knee and hip joints, the shank subassemblies include two shank subassemblies which are arranged in bilateral symmetry below the two thigh subassemblies and are configured to be connected to shanks of the wearer, the elastic member subassemblies include two separately connected elastic member subassemblies which are arranged in bilateral symmetry, connects to only the respective waist support subassembly and the shank subassemblies and passes through the respective clutch subassemblies, wherein the waist support subassembly includes two waist braces, a waist flexible strap and a waist brace connector, the waist brace connector is configured to connect one ends of the two waist braces, and the waist flexible strap is configured to connect the other ends of the two waist braces, so that the two waist braces is connected to the waist to support force generated by the hip-knee passive exoskeleton device, wherein the waist support subassembly further includes boss planes, wherein the spring force arm and pawl force arm connector are connected to the boss planes, and wherein the hip-knee passive exoskeleton device is configured in a way that the elastic member subassemblies are configured to store the energy when the knee joint performs negative work and releases the stored energy to assist the hip joint in performing positive work in a way so that the knee joint energy is able to be transferred to the hip joint by the exoskeleton to assist movement of both the knee joint and hip joint during walking, wherein the assistance in movement of both the knee joint and hip joint is only provided by the stored energy of the elastic member subassemblies.

2. The hip-knee passive exoskeleton device based on clutch time-sharing control according to claim 1, wherein each of the thigh subassemblies includes a thigh rear hoop and a thigh flexible strap, the thigh rear hoop is hinged to the hip joint movement connector, and the thigh flexible strap is configured to closely attach the thigh rear hoop to the thigh.

3. The hip-knee passive exoskeleton device based on clutch time-sharing control according to claim 2, wherein each of the clutch subassemblies includes a clutch bracket, a clutch cover plate, a ratchet wheel, a stroke stop, a wire wheel, a pawl and a pawl rope, wherein the clutch bracket is mounted on the thigh rear hoop, the ratchet wheel, the stroke stop and the wire wheel are mounted between the clutch bracket and the clutch cover plate via a spline shaft to ensure synchronous rotation of the ratchet wheel, the stroke stop and the wire wheel, the pawl is rotatably mounted between the clutch bracket and the clutch cover plate via a pawl shaft, the pawl rope has an upper end connected to the pawl force arm and a lower end connected to the pawl, and the pawl is located on a side of the ratchet wheel and is engageable with the ratchet wheel.

4. The hip-knee passive exoskeleton device based on clutch time-sharing control according to claim 3, wherein each of the shank subassemblies includes a shank rear hoop, a shank front hoop and two shank flexible straps, the shank rear hoop and the shank front hoop are hinged together by hinge pins, and the two shank flexible straps secure the shank rear hoop and the shank front hoop to the shank.

5. The hip-knee passive exoskeleton device based on clutch time-sharing control according to claim 4, wherein each of the elastic element subassemblies includes a tension spring, a spring connecting rope, a pawl torsion spring and a wire wheel torsion spring, wherein the tension spring has an upper end connected to the spring force arm and a lower end connected to an upper end of the spring connecting rope, the spring connecting rope has a middle portion connected to the wire wheel and a lower end connected to the shank rear hoop, the pawl torsion spring is mounted between the pawl and the clutch cover plate to return the pawl to an initial position, and the wire wheel torsion spring is mounted between the wire wheel and the clutch bracket to return the wire wheel to an initial position.

* * * * *